United States Patent [19]

Schmolke

[11] Patent Number: 4,939,897

[45] Date of Patent: Jul. 10, 1990

[54] OPENING CYLINDER UNIT FOR OPEN-END SPINNING MACHINES

[75] Inventor: Karl-Heinz Schmolke, Neuweiler, Fed. Rep. of Germany

[73] Assignee: Hollingsworth GmbH, Fed. Rep. of Germany

[21] Appl. No.: 374,417

[22] Filed: Jun. 30, 1989

[30] Foreign Application Priority Data

Jul. 29, 1988 [DE] Fed. Rep. of Germany ..... 8809697

[51] Int. Cl.[5] ..... D01H 4/32; D01H 11/00

[52] U.S. Cl. ..... 57/301; 57/304; 57/408

[58] Field of Search ..... 57/301, 304, 408, 411, 57/412

[56] References Cited

U.S. PATENT DOCUMENTS

| | | | |
|---|---|---|---|
| 3,626,681 | 12/1971 | Naruse | 57/411 |
| 3,750,380 | 8/1973 | Mladek et al. | 57/411 |
| 3,800,521 | 4/1974 | Doublebsky et al. | 57/301 |
| 4,300,265 | 11/1981 | Heinen | 57/408 X |
| 4,426,840 | 1/1984 | Yasui et al. | 57/301 |
| 4,715,177 | 12/1987 | Stahlecker | 57/408 |
| 4,805,395 | 2/1989 | Stahlecker et al. | 57/408 |
| 4,833,757 | 5/1989 | Stahlecker | 57/408 X |

FOREIGN PATENT DOCUMENTS

| | | |
|---|---|---|
| 2116951 | 10/1971 | Fed. Rep. of Germany . |
| 2752591 | 5/1979 | Fed. Rep. of Germany . |
| 3123480 | 12/1982 | Fed. Rep. of Germany . |

*Primary Examiner*—Joseph J. Hail, III

*Attorney, Agent, or Firm*—Townsend & Townsend

[57] ABSTRACT

The invention relates to an opening cylinder unit for open-end spinning machines. An opening cylinder (3) is mounted to transmit rotations on a shaft rotatable mounted in a bearing housing, which is covered at one front side by an axially fitted cover. The opening cylinder engages over the bearing housing forming a hollow space. In order that the hollow space can be freed from penetrated microdust in simple fashion, at least two cleaning ducts (15) disposed substantially in parallel to the axis of the opening cylinder are formed in the opening cylinder (3), which extend from the hollow space at least to one front side of the opening cylinder. The hollow space can be cleaned by these cleaning ducts using compressed air.

9 Claims, 2 Drawing Sheets

OPENING CYLINDER UNIT FOR OPEN-END SPINNING MACHINES

BACKGROUND OF THE INVENTION

1. Field of the Invention

The invention relates to an opening cylinder unit for open-end spinning machines comprising a shaft rotatably mounted in a bearing housing, on whose free end projecting from the bearing housing an opening cylinder is fixedly mounted, which is preferably covered by a removable, axially placed cover at its front side not facing the bearing housing and which engages over the bearing housing forming a hollow space, which is sealed towards the bearing housing by an annular sealing gap.

2. Brief Description of the Relevant Art

Such an opening cylinder unit is described in the DE-OS 27 52 591. A hollow space formed by the opening cylinder is provided there to protect the bearing of the opening cylinder shaft against soilings such as microdust, which is sealed by a sealing gap between the bearing housing and the opening cylinder. Even if one makes this sealing gap as narrow as possible, one cannot completely prevent dust and impurities from penetrating into the hollow space and from there into the bearing. Since this dust may lead to a certain sluggishness of the opening cylinder, it is desirable to clean the hollow space from time to time. In the known opening cylinder unit the opening cylinder must be removed from the shaft for this purpose, and this is relatively complicated.

An opening cylinder unit is moreover known from DE-PS 31 23 480, in which the opening cylinder unit consists substantially of a basic body and an opening cylinder ring with clothings, which is mounted on it. In this opening cylinder unit the hollow space is covered by the opening cylinder ring. If one wants to clean the hollow space it is still necessary that at least the opening cylinder ring is removed. Since the opening cylinder ring is pressed onto the basic body by means of a clamping element, the exposing of the hollow space for cleaning purposes is relatively expensive, too.

SUMMARY OF THE INVENTION

Therefore it is the object of the present invention to improve an opening cylinder unit of the type mentioned at the beginning in such fashion that the hollow space can be freed from microdust having penetrated through the sealing gap in simple fashion.

According to the invention this object is attached by the fact that at least two cleaning ducts disposed substantially in parallel to the axis of the opening cylinder are formed in the opening cylinder, which extend from the hollow space at least up to a front side of the opening cylinder.

If one wants to clean the hollow space formed between the opening cylinder and the bearing housing in this opening cylinder unit, the easily dismountable cover must at best be removed so that one can supply compressed air into one of the two cleaning ducts by means of a compressed air nozzle. Dust located in the hollow space is then blown out of the other cleaning duct. This cleaning can be carried out in simple fashion since neither a removal of the opening cylinder ring nor a dismounting of the opening cylinder unit is necessary so that the service life of the opening cylinder unit can be prolonged in simple fashion. A cleaning of the hollow space will be effected, as a rule, only if it can be implemented easily like it is done here.

The cleaning of the hollow space can be carried out especially easily, if the cleaning ducts extend through the cover. Then it is not even required to remove the cover.

It is especially advantageous if the opening cylinder consists of a basic body and an opening cylinder ring with clothings exchangeably disposed on it and if the cleaning ducts are formed originating from the basic body. Then the cleaning of the hollow space can be effected independently of the type of the applied opening cylinder ring.

However, it is also favourable if the opening cylinder consists of a basic body and an opening cylinder ring with clothings exchangeably disposed on it and if the cleaning ducts are formed in the inner upper side of the opening cylinder ring facing the basic body. The advantage resides here in particular in that the opening cylinder units already in operation which do not have any cleaning ducts as yet can be easily retrofitted as soon as the opening cylinder rings must anyhow be exchanged due to wear. If such an opening cylinder ring has been mounted, the cleaning of the hollow space is considerably simplified.

Although it would also be possible to directly form the hollow space between opening cylinder ring and the bearing housing, it is advantageous if the hollow space is formed in the basic body and if substantially radial connecting ducts are formed in the basic body which lead from the outer upper side of the basic body facing the opening cylinder ring to the hollow space. Thus there is a direct connection between the connecting ducts and the cleaning ducts without the mechanical strength of the basic body being affected thereby.

If at least one continous, radial recess is formed in the inner upper side of the opening cylinder ring facing the basic body, which connects the radial connecting ducts with the axial cleaning ducts, this has the advantage that the two axial cleaning ducts are always connected to the hollow space completely irrespective of the fact in which relative rotary angles the opening cylinder ring is mounted on the basic body. If a radially projecting centering lug is formed at the end of the basic body facing the bearing housing, the continuous radial recess of the opening cylinder ring can advantageously be adapted to the diameter of the centering lug. The recess may then be axially open and act as centering recess with its end facing the bearing housing, while it establishes the connection between the radial connecting ducts and the axial cleaning ducts in the area not facing the bearing housing.

For fluidic reasons it is advantageous if the cleaning ducts are disposed in diametrally opposite fashion. Due to this, an especially rapid cleaning of the hollow space is achieved if one cleaning duct is acted upon by compressed air.

BRIEF DESCRIPTION OF THE DRAWINGS

Examples of embodiment of the invention are explained in more detail by means of the following drawings.

DETAILED DESCRIPTION OF THE INVENTION AND PREFERRED EMBODIMENTS

Figure 1:
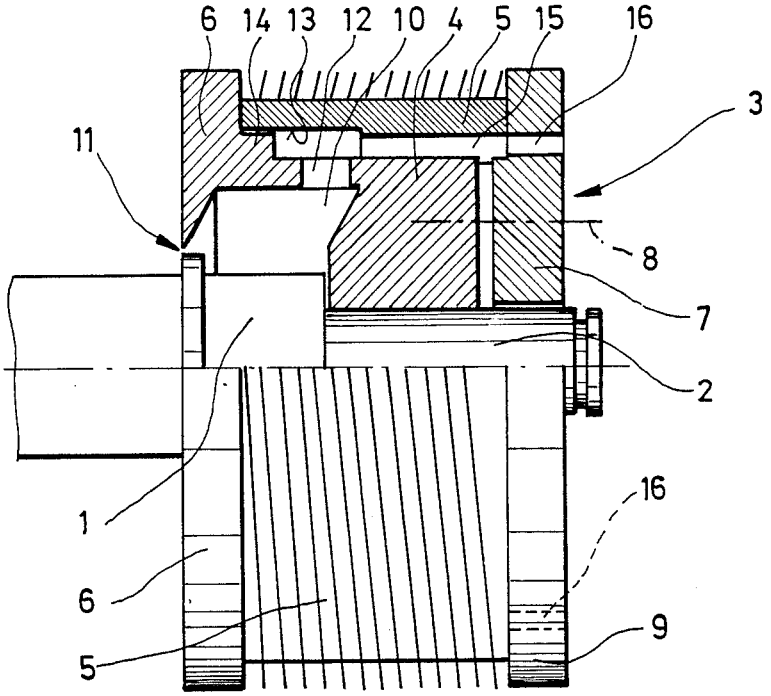
FIG. 1 shows a partially sectioned side view an opening cylinder unit according to a first embodiment.

An opening cylinder unit for open-end spinning machines is represented in the drawing. The opening cylinder unit comprises a bearing housing 1, in which a shaft 2 is rotatably mounted. An opening cylinder 3 is pressed onto the shaft 2 fixed for rotation therewith at its free end projecting from the bearing housing 1. Strictly speaking, the opening cylinder 3 consists of a basic body 4 pressed onto the shaft 2 and an opening cylinder ring 5 slipped onto the outer upper side of the basic body 4. The basic body 4 comprises a collar 6 on the front side facing the bearing housing 1, at which the opening cylinder ring 5 abuts. The opening cylinder 3 is covered by a cover 7 on the front side not facing the bearing housing 1. The cover 7 may be screwed down on the basic body 4 by means of three screws 8 distributed across the circumference, the center lines of them being only outlined; however it is also possible that the cover 7 is screwed to the shaft 2 via a central screw. The cover 7 also comprises a collar 9, with which it braces the opening cylinder ring 5 against the collar 6 of the basic body 4. The basic body 4 fixed to the shaft 2 to transmit rotations engages over the bearing housing 1 and forms a hollow space 10. This hollow space is sealed towards the bearing housing by means of a sealing gap 11 formed between the bearing housing 1 and the basic body 4.

In the example of embodiment represented in FIG. 1 the hollow space is open towards the outer upper side of the basic body 4 by means of two diametrally opposite, radial connecting ducts 12. The opening cylinder ring comprises a continuous recess 13 on its radial upper side facing the basic body, into which the connecting ducts 12 open. A centering lug 14 is provided on the basic body 4 towards the collar 6, which has an outer diameter which corresponds to the inner diameter of the recess 13. Thus the recess 13 is axially open towards the end of the opening cylinder rig 5. Two cleaning ducts 15 being diametrally opposite to each other extend in parallel from the recess 13, to the axis of the opening cylinder 3 to the cover 7.

In the example of embodiment represented in FIG. 1 the cover 7 is traversed by openings 16 conciding with the cleaning ducts 15 so that the cleaning ducts 15 open into the surroundings.

Figure 2:
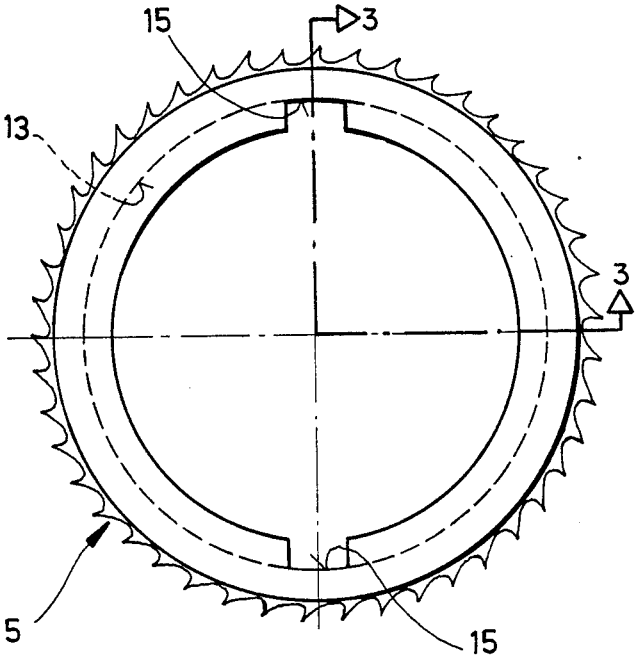
FIG. 2 shows a front view of an opening ring of the opening cylinder unit of FIG. 1.
Figure 3:
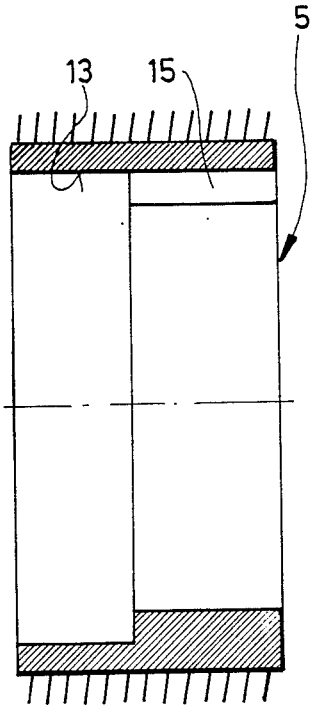
FIG. 3 shows the opening cylinder ring of FIG. 2 sectioned along the line 3—3 and FIG. 4 shows a further example of an opening cylinder unit in a similar view as FIG. 1.
Figure 4:
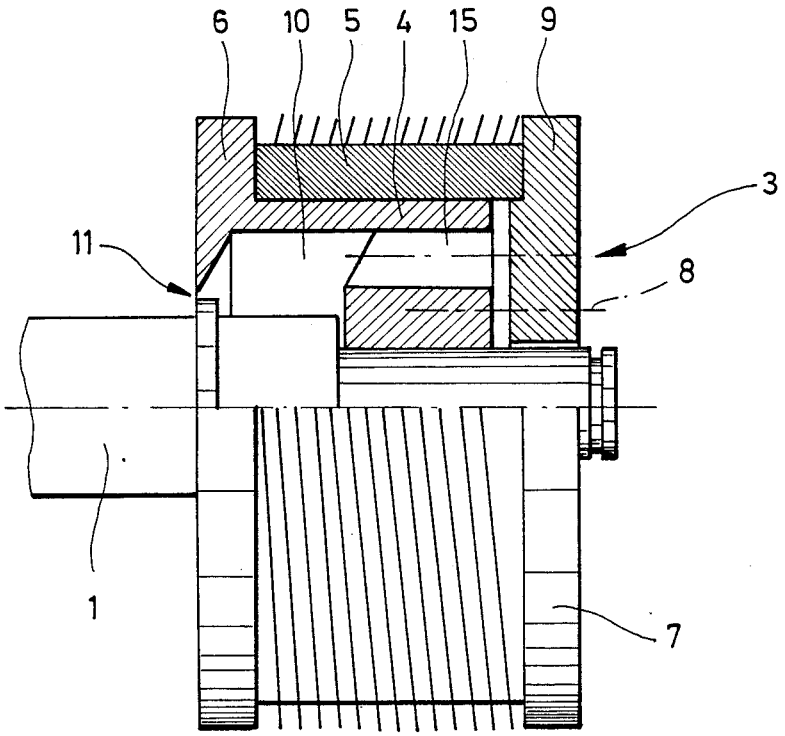

The example of embodiment according to FIG. 4 is described as follows. The same reference numerals are used for similar components. Only the differences to the example of embodiment described in FIGS. 1 to 3 are dealt with.

In the example of embodiment described in FIG. 4 two axial cleaning ducts 15 are provided in the basic body 3, which open directly into the hollow space 10 and reach up to the cover 7. Here no openings are provided in the cover 7 and no grooves or recesses are present in the inner side of the opening cylinder ring 5, because they are not required.

In the following discussion the operation and function of the opening cylinder unit according to the invention is explained in more detail.

During the operation of the open-end spinning machine a certain amount of microdust gets into the hollow space 10 through the sealing gap 11 which can never be made completely tight. The hollow space 10 is capable of receiving a certain amount of microdust without the bearing (not shown) between the bearing housing 1 and the shaft 2 being impaired thereby. If the predetermined amount of microdust is exceeded, it may happen that the microdust gets from the hollow space between the bearing housing 1 and the shaft 2 and from there into the shaft bearing, which leads to an impairing of the shaft bearing. It is therefore desirable to clean the hollow space 10 from time to time. In the example of embodiment shown in FIG. 1 only a pneumatic tool, e.g. the compressed air gun being present in every textile enterprise, must be applied to one of the two openings 16 in the cover 7, and then compressed air is fed. This compressed air flows into the hollow space 10 via the upper cleaning duct 15, the recess 13 and the radial connecting duct 12 and flushes said hollow space. On the side being opposite to the hollow space by 180° the compressed air enriched with microdust gets into the surroundings via the connecting duct which is not visible in Fig, the recess 13, the cleaning duct 15 and finally the opening 16 in the cover 7. This happens without the opening cylinder unit having to be dismounted in any fashion.

In the example of embodiment described in FIG. 4 the hollow space 10 can be cleaned in similar fashion. Here only the cover 7 must only be removed so that one can get directly to one of the cleaning ducts 15 with the penumatic tool. The compressed air fed there gets directly into the hollow space 10 and from there again into the surroundigns via the opposite cleaning duct. Subsequently the cover 7 is again mounted by means of the screws 8.

It is also possible to combine the two examples of embodiment according to FIG. 1 and according to FIG. 4 with each other by forming e.g. one cleaning duct in the inner side of the opening cylinder ring, while the other cleaning duct is formed in the basic body.

I claim:

1. An opening cylinder unit for open-end spinning machines comprising a shaft rotatably mounted in a bearing housing, on whose free end projecting from the bearing housing an opening cylinder is fixedly mounted, which engages over the bearing housing forming a hollow space, which is sealed towards the bearing housing by an annular sealing gap, characterized in that at least two cleaning ducts (15) disposed substantially in parallel to the axis of the opening cylinder unit are formed in the opening cylinder (3), which extend from the hollow space (10) at least to a front side of the opening cylinder not facing the bearing housing.

2. An opening cylinder unit according to claim 1, characterized in that the cleaning ducts (15) extend through the cover (7).

3. An opening cylinder unit according to claim 1 characterized in that the opening cylinder (3) consists of a basic body (4) and an opening cylinder ring (3) with clothings, which is disposed on it in exchangeable fashion and that the cleaning ducts (15) are formed in the basic body.

4. An opening cylinder unit according to claim 1 characterized in that the opening cylinder (3) consists of a basic body (4) and an opening cylinder ring (3) with clothings which is disposed on it in exchangeable fashion and that the cleaning ducts (15) are formed in the inner upper side of the opening cylinder ring (5) facing the basic body (4).

5. An opening cylinder unit according to claim 1 characterized in that the hollow space (10) is formed in the basic body (4) and that substantially radial connecting ducts (12) are formed in the basic body (4) which lead from the outer upper side of the basic body (4) facing the opening cylinder ring (5) to the hollow space (10).

6. An opening cylinder unit according to claim 5 characterized in that at least one continuous radial recess (13) connecting the radial connecting ducts (12) with the axial cleaning ducts (15) is formed in the inner upper side of the opening cylinder ring (3) facing the basic body (4).

7. An opening cylinder unit according to claim 1 characterized in that a radially projecting centering lug (14) is formed at the end of the basic body (4) facing the bearing housing (1) and that the continuous radial recess (13) of the opening cylinder ring (5) is adapted to the diameter of the centering lug (14).

8. An opening cylinder unit according to claim 1 characterized in that the axial cleaning ducts (15) are disposed in diametrically opposite fashion.

9. An opening cylinder unit according to claim 1 characterized in that the opening cylinder is covered by a removable, axially placed cover at its front side.

* * * * *